US005470256A

United States Patent [19]

Waldock

[11] Patent Number: 5,470,256

[45] Date of Patent: Nov. 28, 1995

[54] TWIN ELECTRICAL LEAD AND CONNECTOR ASSEMBLY

[75] Inventor: Kevin H. Waldock, Runaway Bay, Australia

[73] Assignee: Clipmate Corporation, Oklahoma City, Okla.

[21] Appl. No.: 310,201

[22] Filed: Sep. 21, 1994

Related U.S. Application Data

[63] Continuation of Ser. No. 17,526, Feb. 16, 1993, abandoned.

[51] Int. Cl.[6] ..... B65H 55/02

[52] U.S. Cl. ..... 439/501; 102/202.12

[58] Field of Search ..... 439/501, 502; 206/388, 389; 102/202.12; 242/171–175

[56] References Cited

U.S. PATENT DOCUMENTS

| | | | |
|---|---|---|---|
| 1,063,646 | 6/1913 | Bournonville | 242/175 |
| 2,136,031 | 11/1938 | Stuart, II | 102/202.12 |
| 2,393,221 | 1/1946 | Mercer et al. | 102/202.12 |
| 4,643,305 | 2/1987 | De Roure Olivier | 242/174 |
| 4,952,167 | 8/1990 | Hertelendy | 439/395 |
| 5,070,789 | 12/1991 | True et al. | 102/202.12 |

FOREIGN PATENT DOCUMENTS

| | | | |
|---|---|---|---|
| 1060298 | 6/1959 | Germany | 242/174 |
| 2352896 | 5/1975 | Germany | 102/202.12 |

*Primary Examiner*—Neil Abrams
*Attorney, Agent, or Firm*—McKinney, Stringer & Webster

[57] ABSTRACT

A length of leg wire comprising a pair of electrical leads is coiled into a conical helix. An electrical connector is attached at one or both ends. The electrical connector is characterized as capable of maintaining the ends of the two electrical leads in non-conductive and preferably also water-resistant condition. The connector further may also be characterized as permitting a water-resistant, high tensile strength splicing of the ends of the leg wire with another pair of similar electrical leads without the use of splicing tools. The other end of the leg wire may be clean cut or connected to another electrical connector. The coiled portion is flexible but shape sustaining and therefore collapses and expands in the coiled arrangement. The assembly is packaged in the collapsed configuration. When removed from the package, the coiled portion of the leg wire expands but retains the coiled configuration. The coiled leg wire is much easier to work with in the field as the coil expands and retracts readily without tangling. Moreover, the coil configuration allows the wire to rest on its side in the expanded form so that it can be fed down the blast hole easily without the wire becoming tangled. Further, the coiled portion can be retrieved quickly by simply regathering the coiled portion with one hand.

16 Claims, 1 Drawing Sheet

TWIN ELECTRICAL LEAD AND CONNECTOR ASSEMBLY

This is a continuation of application Ser. No. 08/017,526 filed on Feb. 16, 1993 and now abandoned.

FIELD OF THE INVENTION

The present invention relates generally to wiring for electric detonation devices for explosives.

SUMMARY OF THE INVENTION

The present invention is directed to an assembly comprising a leg wire including a pair of electrical leads of equal length. The leg wire has a first end and a second end and a portion therebetween coiled into a conical helix. The coiled portion is characterized as flexible but shape sustaining. An electrical connector is connected to the first end of the leg wire. The electrical connector is characterized as capable of maintaining the ends of the two electrical leads in the leg wire in non-conductive condition.

DETAILED DESCRIPTION OF THE PREFERRED EMBODIMENTS

Figure 1:
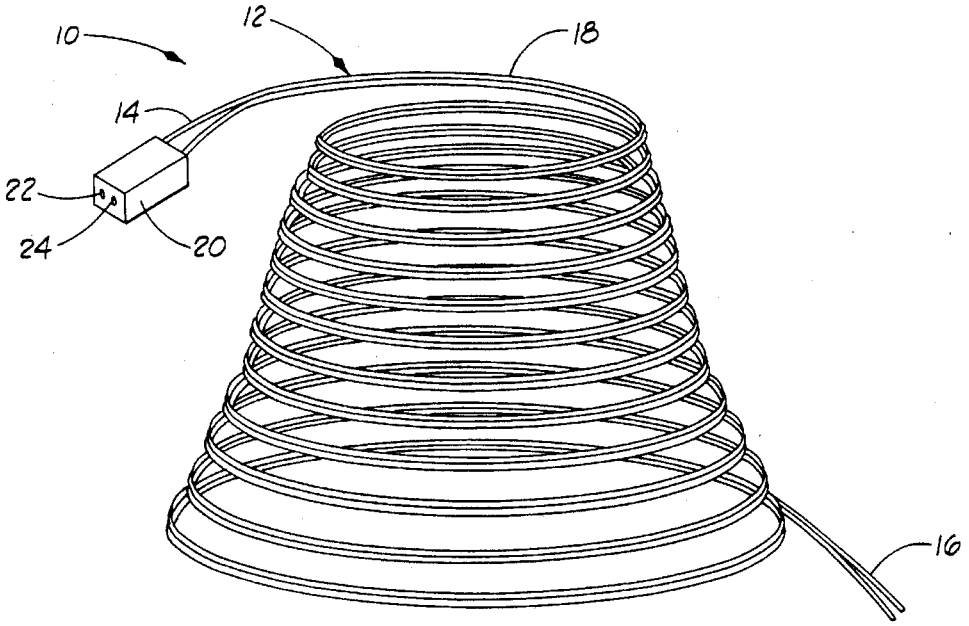
FIG. 1 is a perspective view of a leg wire assembly in accordance with the present invention. The coiled portion of the wire is shown partially expanded for purposes of illustration. For packaging, storage and shipping, the coiled wire is collapsed.

Electric and electronic detonators typically comprise a small charge of explosive contained in a metal casing. The detonators are equipped with twin electrical leads referred to as "leg wires." Detonators are commercially available with leg wires of assorted lengths, such as 16 feet, 24 feet, 50 feet, and so forth. The shorter lengths of wire are gathered in a "figure eight" configuration and secured by a tie of some sort. Lengths of leg wire in excess of about 50 feet typically are mounted on a spool.

Detonators are also manufactured with different delay periods, such as 25 milliseconds, 50 milliseconds, and so forth. Given the specific leg wire lengths and delay periods of conventional detonator products, detailed planning of a particular blasting project is required so that the activation of the detonators can be controlled from a remote control site. Such planning includes an analysis of the number of blast holes, the depth of each hole and the required delay period for each detonator. Then, the operator must purchase the correct number of detonators, ensuring that there is a sufficient number of detonator combinations of each delay period and leg wire length.

To utilize a detonator which has the desired delay period but which has an inadequate length of leg wire, an additional length of leg wire may be attached by splicing it to the ends of the leg wire on the detonator. Industry standards presently require that the ends of the leg wires on detonators be shunted by stripping the insulation jacket for a few inches, twisting the bare conductive core portions of the leads together, and covering the stripped portions of the wire with a non-conductive protective sleeve. This is done to reduce the likelihood that a stray electrical charge will activate the detonator.

To splice on additional leg wire, the ends of the extra leg wire are stripped and joined to the stripped ends of the leg wire from the detonator by twisting the ends together or using a crimping tool. While effective, this splicing procedure is time consuming and inconvenient at the blast site. Moreover, such connections do not provide sufficient tensile strength to withstand the strain of lowering a charge into a blast hole. If the connection breaks and the charge is dropped to the bottom of the hole the retrieval process is hazardous and expensive.

The present invention provides a leg wire assembly comprising a length of leg wire configured in a coil in the form of a conical helix. One end of the leg wire is attached to an electrical connector. The other end of the leg wire may be left bluntly cut or "clean cut" for use with another electrical connector in the field. Alternately, another electrical connector may be attached to the other end.

The leg wire will retain the coiled shape when removed from the package. This makes the assembly easier to use in the field. The wire can be expanded and stretched across a surface so that it is available for feeding the wire doom a blast hole without tangling. Further, the coiled configuration can be easily gathered up with one hand to retrieve the unused portion of the leg wire or to retrieve the leg wire after discharge of the explosive.

Still further, it will be appreciated that the leg wire assembly of this invention will in most instances reduce the cost of materials for a blast job. This is because detonator assemblies with different leg wire lengths (but the same delay period) are interchangeable by using leg wire assemblies of this invention as extensions. Thus, the leg wire assembly of this invention permits the operator to purchase detonators simply by delay periods, rather than the delay period and the leg wire length. This simplifies the planning and execution of a blast job, as all detonators with equal delay periods are made interchangeable. These and other advantages of the present invention will become apparent from the following description.

With reference now to the drawings in general and to FIG. 1 in particular, there is shown therein a leg wire assembly in accordance with the present invention and designated generally by the reference numeral 10. The assembly 10 includes a pair of electrical wires referred to herein collective as the "leg wire" 12. Each electric wire in the leg wire 12 comprises an internal conductive core surrounded by an external insulating jacket. The pair of electrical wires may be two separate insulated wires (as shown) or a pair of wires joined in an integral insulating jacket.

The leg wire 12 has a first end 14 and a second end 16 and a coiled portion 18. The coiled portion generally is in the form of a conical helix, that is, a spiral in which the diameter of the loops gradually decreases from the first end 14 to the second end 16. The coiled portion illustrated in FIG. 1 is partially expanded to better illustrate the configuration of the coil. It will be understood that for packaging, storage and shipping, the coiled portion will be more completely collapsed to minimize the space occupied by the assembly 10.

An electrical connector 20 is attached to the first end 14 of the leg wire 12. The electrical connector 20 is characterized as capable of maintaining the ends of two electrical leads in non-conductive and preferably also a water-resistant condition. Even more preferably, the electrical connector 20 permits a water-resistant, high tensile strength splicing of the leads with another pair of similar electrical leads without the use of splicing tools.

A preferred electrical connector for this purpose is marketed under the name ClipMate™ by ClipMate Corporation (Oklahoma City, Okla.). This electrical connector is described in detail in U.S. Pat. No. 4,952,167, issued Aug. 20, 1990, and the contents of this patent are incorporated herein by reference. A connector of this type is attached to a leg wire by simply inserting the two ends of the leads into the holes 22 and 24 and pulling back until the connector grips the leads.

The second end 16 of the leg wire 12 may be clean cut in a conventional manner, as shown in FIG. 1. Alternately, the second end 16 of the leg wire 12 may be connected to another electrical connector.

Figure 2:
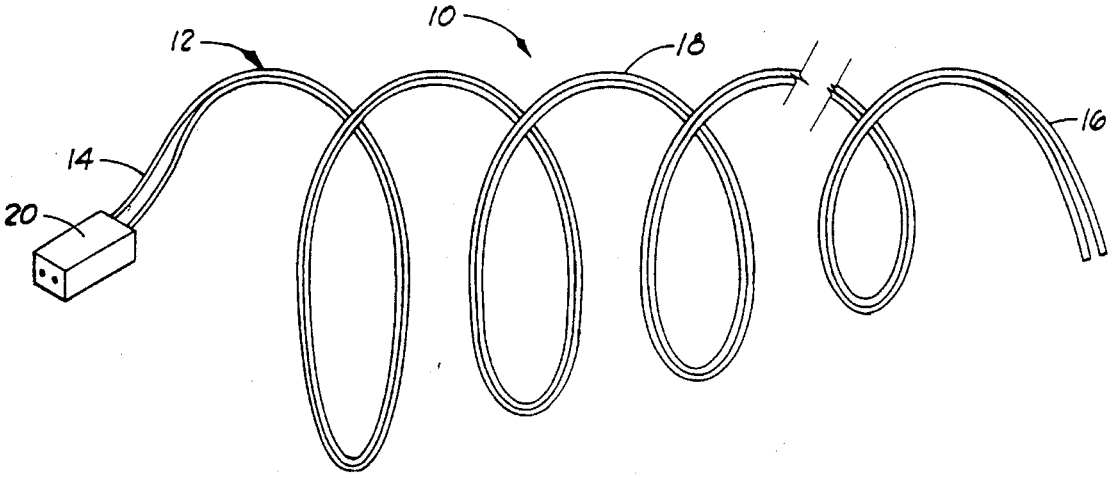
FIG. 2 is a perspective view of a leg wire assembly in use with the coiled portion expanded across a surface.

Turning now to FIG. 2, the use of the assembly 10 will be described. The assembly 10 is removed from the package (not shown), placed on its side on a surface 28 and loosely expanded across the surface as shown in FIG. 2. In the preferred use of the assembly 10, the clean cut second end 16 of the leg wire 12 is connected to the leg wire of a detonator assembly comprising a detonator with an attached electrical connector similar to the electrical connector 20. Such a detonator assembly is shown and described in detail in U.S. Pat. No. 5,392,712, issued Feb. 28, 1995, entitled ELECTRIC DETONATOR AND LEAD CONNECTOR ASSEMBLY, filed concurrently herewith, and the contents of that application are incorporated herein by reference. This product is marketed under the brand name ROS-DET™ by ClipMate Corporation (Oklahoma City, Okla.). However, it will be appreciated that end 16 of the leg wire 12 of the assembly 10 of this invention also may be spliced to another leg wire in the conventional manner.

In the expanded position illustrated in FIG. 2, the coiled portion 18 of the leg wire 12 may be conveniently extended or retracted without becoming tangled. Unused leg wire may be retrieved by simply scooping up the free standing coils with one hand. Similarly, the entire assembly 10 can be retrieved by regathering the coiled portion 18, as the leg wire readily reassumes its coiled configuration.

While in the preferred embodiment, a connector 20 is attached to the first end 14 of the leg wire 12 and the second end 16 is clean cut, it will be appreciated that leg wire assemblies comprising a second connector on the second end 16 also are within the scope of the present invention.

Changes may be made in the combination and arrangement of the various parts, elements, steps and procedures described herein without departing from the spirit and scope of the invention as defined in the following claims.

I claim:

1. A self dispensing leg wire and connector assembly for providing an electrical conductor between a charge of explosives at a blast site and a remote control site, the assembly consisting essentially of:

a selected length of leg wire, the leg wire comprising a pair of pliable electrical leads of equal length, wherein the length of the leg wire is selected to be about the same as the distance between the blast site and the control site, wherein the leg wire has a first end and a second end and a coiled portion therebetween formed into a conical helix whereby both ends of the leg wire are accessible when the assembly is placed on its side on a surface, wherein the coiled portion is shape sustaining so that the assembly will retain its coiled configuration when placed on its side, and wherein the coiled portion is flexible so that, when placed on its side, the coil can be expanded by pulling on either end; and an electrical connector connected to the first end of the leg wire, the connector being characterized as capable of maintaining the two leads of the first end of the leg wire in non-conductive condition.

2. The assembly of claim 1 wherein the electrical connector is characterized as maintaining the two leads of the leg wire in a water-resistant condition.

3. The assembly of claim 1 wherein the electrical connector is characterized as permitting a water-resistant, high tensile strength splicing of the leg wire with two similar electrical leads without the use of splicing tools.

4. The assembly of claim 1 wherein each one of the electrical leads includes an exposed electrical conductor at the second end of the leg wire.

5. A self dispensing leg wire and connector assembly for providing an electrical conductor between a charge of explosives at a blast site and a control site, consisting essentially of:

a selected length of leg wire, the leg wire comprising a pair of pliable electrical leads of equal length, wherein the length of the leg wire is selected to be about the same as the distance between the blast site and the control site, wherein the leg wire has a first end and a second end and a coiled portion therebetween formed into a conical helix whereby both ends of the leg wire are accessible when the assembly is placed on its side on a surface, wherein the coiled portion is shape sustaining so that the assembly will retain its coiled configuration when placed on its side, and wherein the coiled portion is flexible so that, when placed on its side, the coil can be expanded by pulling on either end; and an electrical connector connected to the first end and the second end of the leg wire, each connector being characterized as capable of maintaining the two leads of the end of the leg wire in non-conductive condition.

6. The assembly of claim 5 wherein each electrical connector is characterized as maintaining the two leads of end of the leg wire in a water-resistant condition.

7. The assembly of claim 5 wherein each of the electrical connectors is characterized as permitting a water-resistant, high tensile strength splicing of the leg wire with two similar electrical leads without the use of splicing tools.

8. The assembly of claim 5 wherein each one of the electrical leads includes an exposed electrical conductor at the second end of the leg wire.

9. A method for dispensing leg wire for establishing a conductor between a charge of explosives at a blast site and a remote control site, the method comprising:

providing a self dispensing leg wire comprising a pair of pliable electrical leads of equal length, wherein the length of the leg wire is selected to be at least a portion of the distance between the blast site and the control site, wherein the leg wire has a first end and a second end and a coiled portion therebetween formed into a conical helix whereby both ends of the leg wire are accessible when the assembly is placed on its side on a surface, wherein the coiled portion is shape sustaining so that the assembly will retain its coiled configuration when placed on its side, and wherein the coiled portion is flexible so that, when placed on its side, the coil can be expanded by pulling on either end;

placing the assembly on its side on a surface between the blast site and the control site, so that the coiled portion is free standing and expandable, and so that both ends of the leg wire are accessible; and expanding the coiled portion by pulling on either or both of the ends of the leg wire until the leg wire has been extended to the desired length.

10. The method of claim 9 wherein the leg wire is further defined as having an electrical connector connected to one end, the connector being characterized as capable of maintaining the two leads of the end of the leg wire in non-conductive condition.

11. The method of claim 10 wherein the connector is further characterized as maintaining the ends of the leg wire in water-resistant condition.

12. The method of claim 10 wherein the connector is characterized as permitting a water-resistant, high tensile strength splicing of the leg wire with two similar electrical leads without the use of splicing tools.

13. The method of claim 10 wherein the each of the leads on the other end of the leg wire includes an exposed electrical conductor.

14. The method of claim 9 wherein the leg wire is further defined as having an electrical connector connected to each end, each such connector being characterized as capable of maintaining the two leads of the end of the leg wire in non-conductive condition.

15. The method of claim 14 wherein each connector is further characterized as maintaining the ends of the leg wire in water-resistant condition.

16. The method of claim 14 wherein each connector is characterized as permitting a water-resistant, high tensile strength splicing of the leg wire with two similar electrical leads without the use of splicing tools.

* * * * *